United States Patent [19]

Saito et al.

[11] 4,394,974

[45] Jul. 26, 1983

[54] FUEL INJECTOR VALVE

[75] Inventors: Masaaki Saito, Yokosuka; Tadaki Ota, Kawasaki, both of Japan

[73] Assignee: Nissan Motor Co., Ltd., Yokohama, Japan

[21] Appl. No.: 242,421

[22] Filed: Mar. 11, 1981

[30] Foreign Application Priority Data

Mar. 24, 1980 [JP] Japan ..... 55-38319[U]

[51] Int. Cl.[3] ..... B05B 1/30

[52] U.S. Cl. ..... 239/585

[58] Field of Search ..... 239/585, 533; 251/129, 251/141, 337

[56] References Cited

U.S. PATENT DOCUMENTS

| | | | |
|---|---|---|---|
| 3,865,312 | 2/1975 | Lombard et al. | 239/585 |
| 4,218,021 | 8/1980 | Palma | 239/585 |
| 4,264,040 | 4/1981 | Saito | 239/585 |
| 4,308,890 | 1/1982 | Saito | 239/585 X |

FOREIGN PATENT DOCUMENTS

| | | |
|---|---|---|
| 2548774 | 5/1977 | Fed. Rep. of Germany . |
| 1664612 | 4/1928 | France . |

*Primary Examiner*—Joseph E. Valenza
*Assistant Examiner*—Gene A. Church

[57] ABSTRACT

A fuel injector valve comprises a main magnetic pole securely disposed within a casing and provided with an electromagnetic coil wound thereon, a valve seat member securely connected to the casing so as to be located opposite to the main magnetic pole tip section, a spherical valve member movably disposed within a valve chamber which is to be filled with fuel, and defined between the main magnetic pole tip section and the valve seat member, and an adapter member securely interposed between the main magnetic pole and the casing to secure the locational relationship therebetween, thereby securely achieving the locating and centering of the main magnetic pole.

6 Claims, 2 Drawing Figures

FUEL INJECTOR VALVE

BACKGROUND OF THE INVENTION

1. Field of the Invention

This invention relates to an improvement in a fuel injector valve for supplying fuel to an internal combustion engine, more particularly to an improvement in the fuel injector valve of the type wherein a spherical movable member is used as a valve member.

2. Prior Art of the Invention

Nowaways, many internal combustion engines of automotive vehicles are provided with a fuel injection system which can controllably supply the combustion chambers of the engine with fuel accurately in response to engine operating conditions. The fuel injection system comprises a fuel injector valve located in an intake air passageway upstream of an intake manifold or a plurality of fuel injector valves located in the vicinity of exhaust ports. The fuel injector valve is usually electrically controlled to open or close so as to control the fuel injection therefrom in accordance with an electric signal supplied thereto. Of various kinds of fuel injector valves, there is one of the type wherein an electromagnetically movable spherical valve member is used to open or close the fuel injection opening through which fuel is injected out of the fuel injector valve.

BRIEF SUMMARY OF THE INVENTION

A fuel injector valve according to the present invention comprises a main magnetic pole securely disposed within a casing and provided with an electromagnetic coil wound thereon, a valve seat member securely connected to the casing so as to be located opposite to the tip section of the main magnetic pole, and a spherical valve member movably disposed within a valve chamber defined between the main magnetic pole tip section and the valve seat member. The fuel injector valve further comprises an adaptor member securely interposed between the main magnetic pole tip section and the inner surface of the casing to secure the locational relationship therebetween. With this arrangement, the locating and centering of the main magnetic pole is securely achieved, rendering unnecessary a support member for the electromagnetic coil.

BRIEF DESCRIPTION OF THE DRAWINGS

The features and advantages of the fuel injector valve according to the present invention will be more clearly appreciated from the following description taken in conjunction with the accompanying drawings, in which.

DETAILED DESCRIPTION OF THE INVENTION

Figure 1:
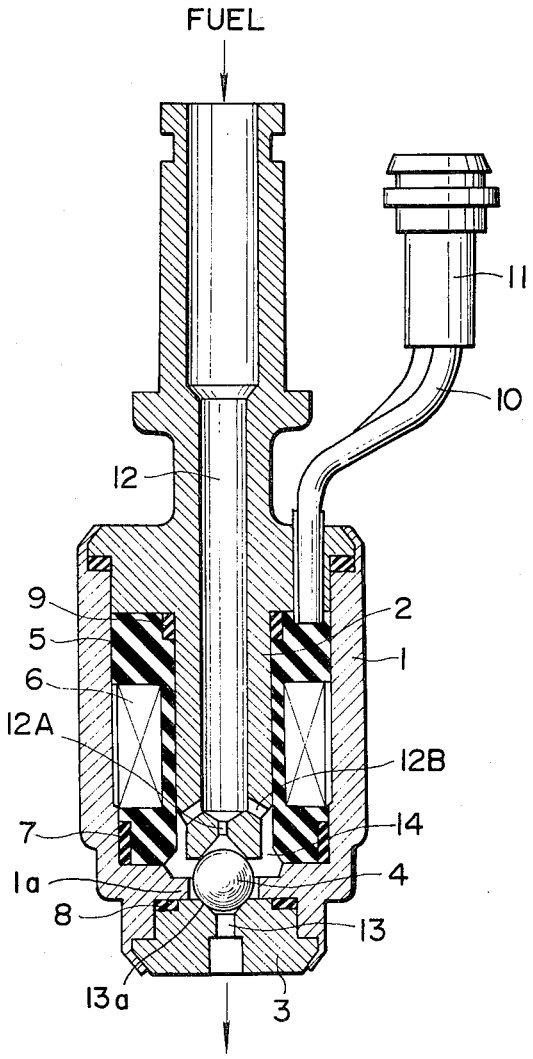
FIG. 1 PRIOR ART
FIG. 1 is a longitudinal section view of a conventional fuel injector valve.

To facilitate understanding the present invention, a brief reference will be made to a conventional fuel injector valve, depicted in FIG. 1. Referring to FIG. 1, a conventional fuel injector valve is shown having a casing 1 within which a main magnetic pole 2 and a valve seat member 3 are securely disposed so that the tip section of the main magnetic pole is opposite to a valve seat 13A formed at the valve seat member. A spherical valve member 4 is movably located between the main magnetic pole tip section and the valve seat 13A. Additionally, a side magnetic pole 1A forming part of and integral with the casing 1 is disposed around the spherical valve member 4. The distance of the main magnetic pole member 2 from the valve seat member 3 is so set that the valve member 4 is operated to lift in the order of several ten microns between the main magnetic pole tip section and the valve seat 13A.

A coil bobbin 5 made of an insulating material is disposed around the outer surface of the main magnetic pole 2, on which bobbin an electromagnetic coil 6 is wound. The coil 6 is supplied with electric current via a lead 10 and an electric connector 11.

The main magnetic pole 2 is formed therein with an axial fuel passage 12 whose end section leads to a fuel discharge port 12A through which fuel pressure directly acts on the valve member 4 and a fuel introduction port 12B through which the fuel from the fuel passage 12 is introduced to a valve chamber 14 within which the valve member 4 is disposed. The valve seat member 3 is formed with a fuel injection opening 13 merged into the valve seat 13A. In order to prevent fuel from leaking, an O-ring 7 is disposed between the casing 1 and the bobbin 5, an O-ring 8 is disposed between the casing 1 and the valve seat member 3, and an O-ring 9 is disposed between the bobbin 5 and the pole 2.

With this arrangement, when the electromagnetic coil 6 is supplied with electric current, the magnetic force acts on the spherical valve member 4 to lift it upwardly. Then, the side magnetic pole 1A serves as guiding means for the magnetic force, thereby causing the magnetic force of the main magnetic pole 2 to effectively act on the valve member 4. Accordingly, the spherical valve member 4 can be instantaneously attracted to the tip section of the main magnetic pole 2 against the fuel pressure. As a result, the fuel introduced from the fuel passage 12 through the introduction port 12B to the valve chamber 14 is ejected under pressure from the fuel injection opening 13 of the valve seat member 3.

When the supply of electric current to the electromagnetic coil 6 is interrupted, the spherical valve member 3 is seated on the valve seat 13A of the valve seat member 13 by the fuel pressure within the valve chamber 14, thereby closing the fuel injection opening to stop the fuel injection from the fuel injector valve. In this regard, it will be appreciated that a necessary amount of fuel can be supplied at a desired timing by controlling the electric pulse signal supplied to the electromagnetic coil 6 in the fuel injector valve as arranged hereinbefore.

Now, the above-discussed fuel injector valve is so constructed and arranged that the electromagnetic coil 6 is supported through the bobbin 5 on the main magnetic pole 2, and the bobbin 5 is usually made of a relatively soft and electrically insulating material such as a plastic. The bobbin 5 is interposed between the casing 1 and the main magnetic pole member 2, i.e., the major part of the main magnetic pole 2 is supported on the casing through the relatively soft plastic bobbin 5. Therefore, due to insufficient dimensional accuracy of the bobbin 5 and to the deformation of the bobbin 5 after it is set in position, the axis of the main magnetic pole 2 is liable to deviate from the center axis of the fuel injector valve. When the centering of the main magnetic pole 2 is not right, the valve seating onto the main magnetic pole tip section and the valve seat 13A will affect the fuel injection amount characteristics. In addition, due to the employment of the bobbin 5, the size of the fuel injector valve unavoidably increases by the amount corresponding to the bobbin 5. These are quite disadvantageous for fuel injector valves to be used in modern automotive internal combustion engines.

Figure 2:
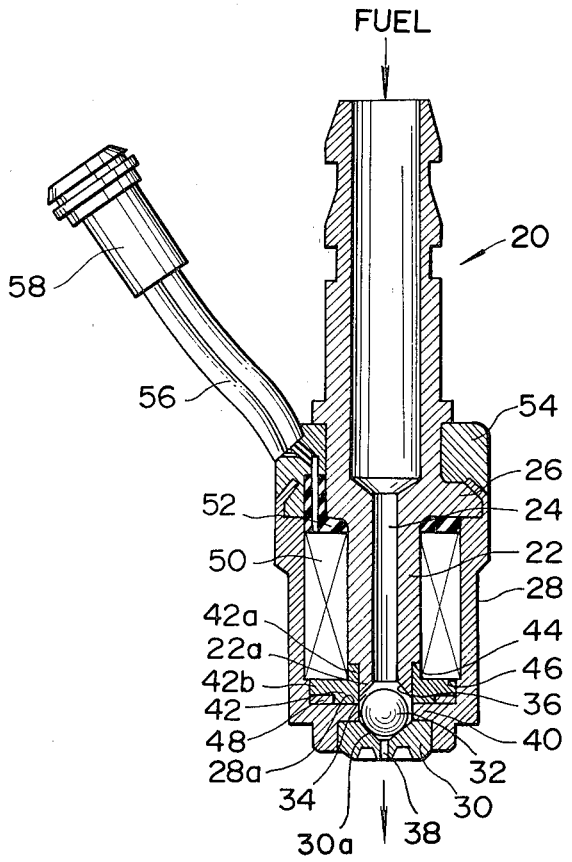
FIG. 2 is a longitudinal sectional view of a fuel injector valve in accordance with the present invention.

In view of the above description of the conventional fuel injector valve, reference is now made to FIG. 2 wherein a preferred embodiment of the fuel injector valve according to the present invention is illustrated by the reference numeral 20. The fuel injector valve 20 comprises a cylindrical main magnetic pole 22 through which an axial fuel passage 24 is formed. The main magnetic pole 22 is formed with a flange section 26 which is securely connected to a casing 28 by caulking the upper annular end section of the casing 28 on the flange section 26. A valve seat member 30 is securely held by the bottom section of the casing 28 so that the axis thereof is aligned with the axis of the main magnetic pole 22. A spherical valve member 32 is movably disposed within a valve chamber 34 defined between the main magnetic pole tip section and the valve seat member 30. In this connection, the tip section of the main magnetic pole 22 is formed with a valve contacting surface 36 which is opposite to a valve seat section 30*a* of the valve seat member 30. The valve seat member 30 is formed with a fuel injection opening 38 through which the fuel within the valve chamber 34 is ejected out of the fuel injector valve 20. Accordingly, the fuel passage 24 of the main magnetic pole 22 connects through the valve contacting surface 36 with the valve chamber 34, while the fuel ejection opening 38 connects through the valve seat section 30*a* with the valve chamber 34. It will be understood that the spherical valve member 32 is movable upwardly and downwardly between the valve contacting surface 36 and the valve seat section 30*a*. An annular side magnetic pole 40 is formed spacedly around the spherical valve member 32 to guide the magnetic force from the main magnetic pole 22. The side magnetic pole 40 is formed integral with the casing 28, and defines a bottom inner surface 28*a* of the casing 28. The lower inner surface 28*a* is annular and flat, and perpendicular to the axis of the fuel injector valve 20.

An annular adapter member 42 is provided or interposed between the main magnetic pole 22 and the casing 28 so as to securely connect them. As shown, the adapter member 42 includes a cylindrical section 42*a* and a radially and outwardly extending flange section 42*b* which are both coaxial with the main and side magnetic poles 22, 40. The cylindrical section 42*a* is securely fitted in a peripheral cutout section 44 formed at the tip section of the main magnetic pole 22, while the flange section 42*b* is fitted in a lower inner recess 46 of the casing 28 so that the bottom surface of the flange section 42*a* securely contacts the casing bottom inner surface 28*a* defined by or forming part of the side magnetic pole 40. An O-ring 48 is provided in a groove (no numeral) formed at the adapter flange section 42*b* to prevent fuel leaking between the adapter 42 and the casing 28.

An electromagnetic coil 50 is wound around the outer surface of the main magnetic pole 22 and disposed within an annular space defined by the main magnetic pole 22, the casing 28, and the adapter member 42. A washer 52 made of a plastic is interposed between the coil 50 and the flange section 26 of the main magnetic pole 22, and a cover 54 covers the caulking section of the casing 28, in order to secure or fix the connecting section of a lead 56 to the coil 50. The lead 56 electrically connects the coil 50 with an electrical connector 58. It will be appreciated that the casing 28 containing the side magnetic pole 40 and the main magnetic pole 22 are made of a magnetic material in order to cause the magnetic force of the coil 50 to effectively act on the spherical valve member 32, while the adapter member 42 and the valve seat member 30 are made of a non-magnetic material. It is preferable that the section of the main magnetic pole 22 and the section of the adapter member 42 both contacting the coil 50 are covered with an electrically insulating material such as Teflon (polytetrafluoroethylene) or polyester resin.

It will be appreciated that the fuel injector valve 20 shown in FIG. 2 operates similarly to that shown in FIG. 1, i.e., the spherical valve member 32 lifts by being attracted by the main magnetic pole 22 to inject fuel through the fuel injection opening 38 when the coil 50 is energized upon receiving electric current, while the spherical valve member 32 is seated on the valve seat section 30*a* to interrupt the fuel injection through the fuel injection opening 38 when the coil is de-energized upon no electric current being supplied thereto.

With the above-discussed arrangement of the fuel injector valve 20, the tip section of the main magnetic pole 22 can be rightly located at the desired position by virtue of the adapter member 42 interposed between the main magnetic pole tip section 22*a* and the casing 28. Therefore, the centering of the main magnetic pole 22 relative to the valve seat member 30 can be easily achieved. Additionally, by virtue of the adapter member 42, the locating or centering of the main magnetic pole 22 can be achieved even if the rigidity of the casing 28 is low to some extent, by which it is possible to make thinner the wall thickness of the casing 28. Furthermore, since the coil 50 is directly supported by the main magnetic pole 22 and the adapter 42, without using any coil support member such as the bobbin 5 shown in FIG. 1, the outer diameter of the casing 28 can be made smaller. Therefore, a small-sized fuel injector valve can be obtained. In addition, the fuel leakage from the valve chamber 34 to the coil 50 side can be prevented by using the O-ring at the above-mentioned location, thereby contributing to simplification of the assembly process and to lowering the cost for parts.

As appreciated from the above, according to the present invention, the precise locating or centering of the main magnetic pole can be easily achieved. Accordingly, fuel flow or injection amount variation due to failed seating of the valve member 32 can be effectively avoided to exhibit stable fuel injection amount characteristics, realizing a compact size and low cost fuel injector valve.

What is claimed is:

1. A fuel injector valve, comprising:

a casing;

a main magnetic pole securely disposed within said casing and provided with an electromagnetic coil wound thereon, said main magnetic pole being elongate and cylindrical and formed with an axial fuel passage through which fuel is supplied and a tip section;

a valve seat member securely connected to said casing so as to be located opposite to the tip section, said valve seat member being formed with a fuel injection opening through which fuel is dischargeable out of said fuel injector valve, the axis of said fuel injection opening being aligned with the axis of the fuel passage of said main magnetic pole;

a spherical valve member movably disposed within a valve chamber to be filled with fuel, said valve chamber being defined between the main magnetic pole tip section and said valve seat member, the fuel within said fuel chamber being supplied through the fuel passage of said main magnetic pole and dischargeable out of said fuel chamber through the fuel injection opening of said valve seat member; and a side magnetic pole securely connected to said casing and located spaced around said spherical valve member, the axis of said side magnetic pole being aligned with the axis of said main magnetic pole; and an adapter member in contact with and interposed between the main magnetic pole tip section and said casing to secure the locational relationship therebetween, said adapter member being generally annular and having inner and outer peripheral surfaces which securely contact the main magnetic pole and said casing, respectively; said adapter member including a cylindrical section containing said inner peripheral surface thereof, and a radially and outwardly extending flange section containing the outer peripheral surface thereof, said cylindrical section being fitted in a peripheral cutout section of said main magnetic pole, said flange section being fitted in a lower inner recess of said casing so that the bottom surface thereof contacts said side magnetic pole.

2. A fuel injector valve as claimed in claim 1, wherein a closed space in which said electromagnetic coil is disposed is formed by said casing, said adapter member, said main magnetic pole, and a flange section formed with said main magnetic pole.

3. A fuel injector valve as claimed in claim 2, wherein said adapter member and said valve seat member are made of a non-magnetic magnetic material.

4. A fuel injector valve as claimed in claim 3, wherein said casing is made of a magnetic material and integral with said side magnetic pole.

5. A fuel injector valve, comprising:

a casing;

a main magnetic pole securely disposed within said casing and provided with a tip section and having an electromagnetic coil wound thereon;

a valve seat member securely connected to said casing so as to be located opposite to the tip section of said main magnetic pole;

a spherical valve member movably disposed within a valve chamber to be filled with fuel, said valve member being defined between the main magnetic pole tip section and said valve seat member; and an adapter member in contact with and interposed between the main magnetic pole tip section and said casing to secure the locational relationship therebetween, said adapter member being generally annular and having inner and outer peripheral surfaces which securely contact said main magnetic pole and said casing, said adapter member including a cylindrical section contacting the inner peripheral surface thereof, and a radially and outwardly extending flange section containing the outer peripheral surface thereof, said cylindrical section being fitted in a peripheral cutout section of said main magnetic pole, said flange section being fitted in a lower inner recess of said casing.

6. A fuel injector valve, comprising:

a casing;

a main magnetic pole securely disposed within said casing and provided with a tip section and having an electromagnetic coil wound thereon;

a valve seat member securely connected to said casing so as to be located opposite to the tip section of said main magnetic pole;

a spherical valve member movably disposed within a valve chamber to be filled with fuel, said valve chamber being defined between the main magnetic pole tip section and said valve seat member;

a side magnetic pole securely connected to said casing and located spaced around said spherical valve member, the axis of said side magnetic pole being aligned with the axis of said main magnetic pole; and an adapter member in contact with and interposed between the main magnetic pole tip section and said casing to secure the locational relationship therebetween, said adapter member being generally annular and having inner and outer peripheral surfaces which securely contact said main magnetic pole and said casing, respectively, said adapter member including a cylindrical section containing the inner peripheral surface thereof, and a radially and outwardly extending flange section containing the outer peripheral surface thereof, said cylindrical section being fitted in a peripheral cutout section of said main magnetic pole member, said flange section being fitted in a lower inner recess of said casing so that the bottom surface thereof contacts said side magnetic pole.

* * * * *